United States Patent [19]

Hall

[11] Patent Number: 4,637,387

[45] Date of Patent: Jan. 20, 1987

[54] BREATHING APPARATUS

[76] Inventor: Lester B. Hall, 249 Kinsey Ave., Kenmore, N.Y. 14217

[21] Appl. No.: 498,932

[22] Filed: May 27, 1983

Related U.S. Application Data

[63] Continuation-in-part of Ser. No. 404,059, Aug. 2, 1982, Pat. No. 4,573,463.

[51] Int. Cl.[4] ..... A62B 9/00; A62B 18/02

[52] U.S. Cl. ..... 128/205.24; 128/208.25; 128/206.28; 128/206.29; 128/207.14

[58] Field of Search ..... 128/201.26, 201.28, 128/205.22, 208.25, 206.12, 206.15, 206.21, 128/206.28, 206.29, 207.12, 207.14, 205.21, 205.12, 128/207.18, 205.17, 206.27, 205.24, 203.29, 204.11, 128/912; 285/331, 319, 95, 96, 98, 278, 279, DIG. 285/22; 215/29, 224, DIG. 3; 220/85 R, 85 S

[56] References Cited

U.S. PATENT DOCUMENTS

| | | | |
|---|---|---|---|
| 439,093 | 10/1890 | Barian | 128/206.29 |
| 728,476 | 5/1903 | Langer | 128/201.26 |
| 2,587,958 | 3/1952 | Belloni | 128/201.27 |
| 2,810,387 | 10/1957 | Arpin et al. | 128/205.24 |
| 3,019,788 | 2/1962 | Hughes | 128/205.24 |
| 3,045,671 | 7/1962 | Updegraff | 128/205.21 |
| 3,182,659 | 5/1965 | Blount | 128/207.12 |
| 3,186,407 | 6/1965 | Morrison | 128/208.25 |
| 3,238,940 | 3/1966 | Kopas | 128/205.24 |
| 3,490,452 | 1/1970 | Greenfield | 128/206.28 |
| 3,976,067 | 8/1976 | Amlong | 128/205.24 |
| 4,062,356 | 12/1977 | Merrifield | 128/205.22 |
| 4,365,628 | 12/1982 | Hodel | 128/205.21 |

FOREIGN PATENT DOCUMENTS

| | | | |
|---|---|---|---|
| 0031409 | 7/1981 | European Pat. Off. | 285/DIG. 22 |
| 602071 | 2/1960 | Italy | 128/206.29 |
| 464623 | 12/1968 | Switzerland | 285/DIG. 22 |

OTHER PUBLICATIONS

"Life Support Oxygen System", *Mada Medical Products, Inc.,* 5 pp., Oct. 11, 1972.

*Primary Examiner*—Henry J. Recla
*Assistant Examiner*—Karin M. Reichle
*Attorney, Agent, or Firm*—Christel, Bean & Linihan

[57] ABSTRACT

Breathing apparatus comprising a mask shaped to contact a user's face and define a breathing chamber in communication with the nose of the user, a gas supply container carried by the mask having a movable valve control element, and an operator manipulated by the mouth of the user for moving the control to open the valve to introduce gas to the breathing chamber. The gas supply is controlled by the mouth of the user and inhaling from and exhaling to the chamber is through the nose of the user. The operator is carried by the body for association with the mouth of the user for moving the valve control element between open and closed positions in response to manipulation by the mouth of the user, and an exhalation valve is in the mask in communication with the breathing chamber. The apparatus can include a fluid-tight connector between the gas supply container outlet and an inlet to the breathing chamber, a manually operated member for opening and closing the valve, and a pressure gauge in the container for monitoring the pressure of the contents thereof.

12 Claims, 13 Drawing Figures

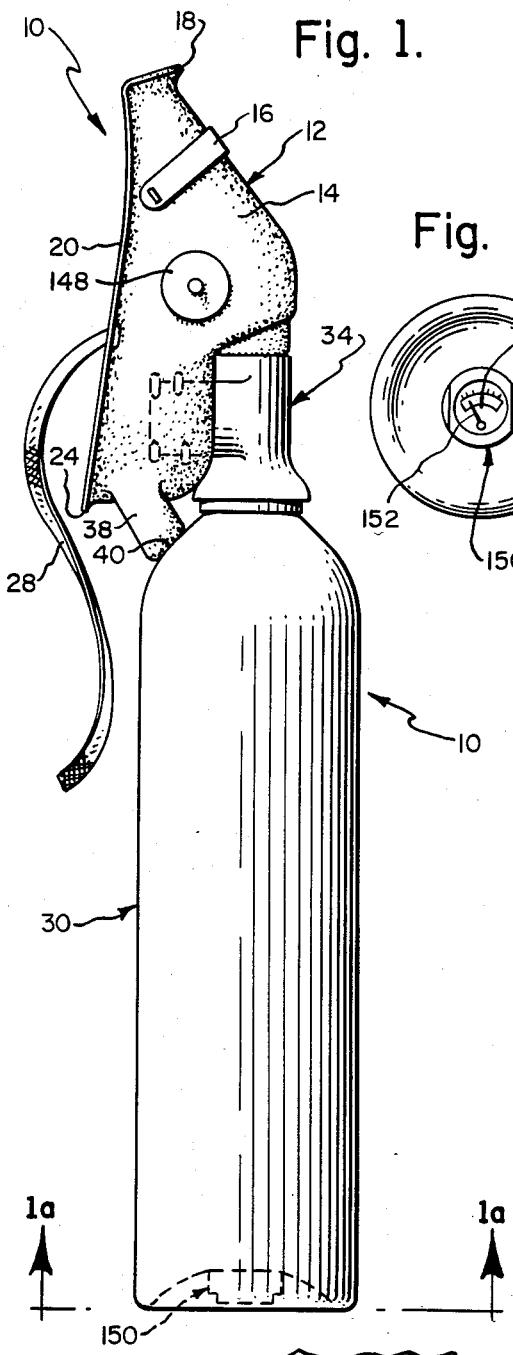
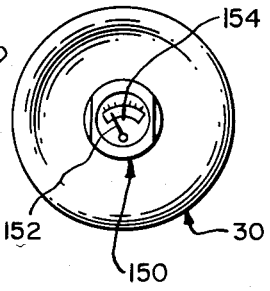
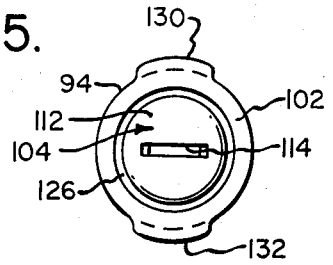
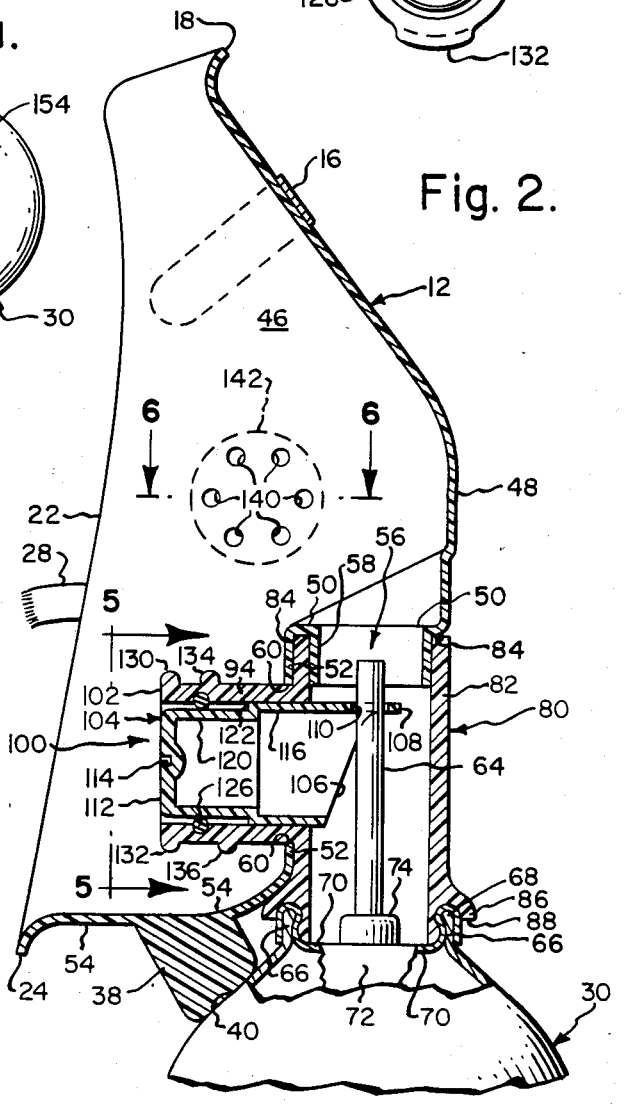
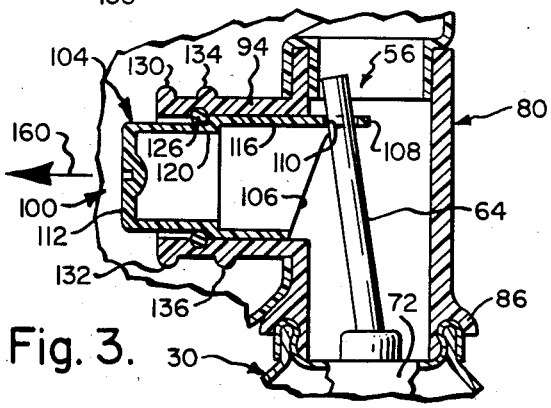
Fig. 3.
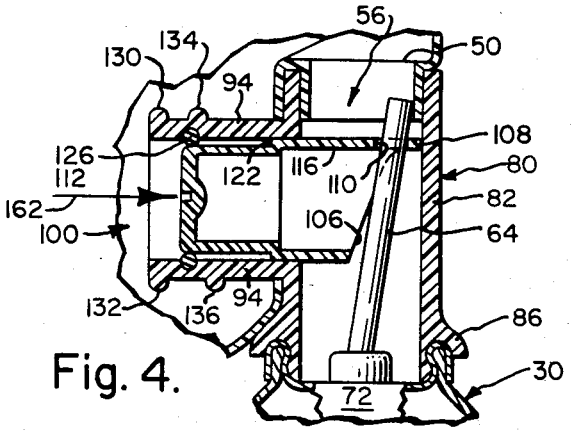
Fig. 4.

Fig. 6.
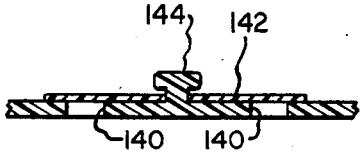
Fig. 7.
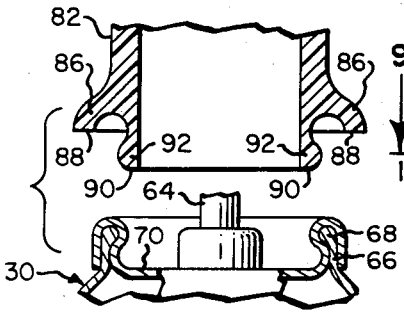
Fig. 8.
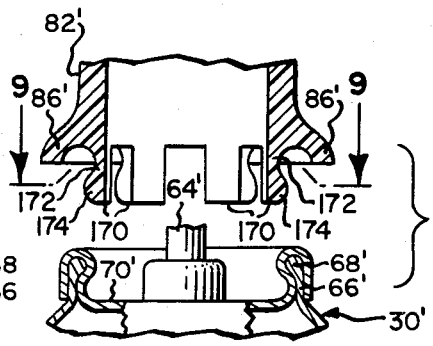
Fig. 9.
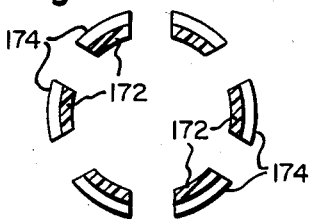
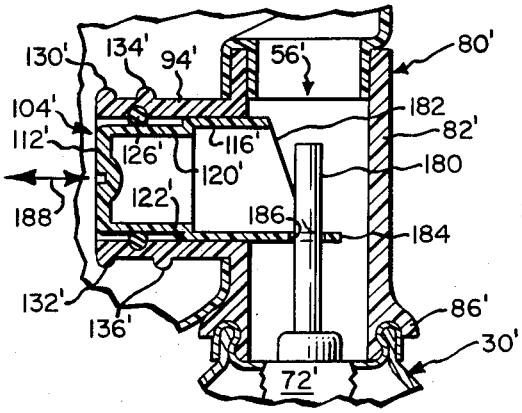
Fig. 10.
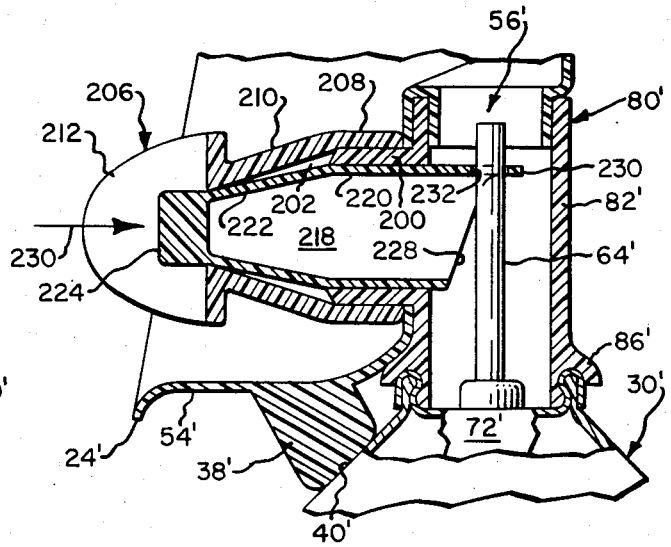
Fig. 12.
Fig. 11.
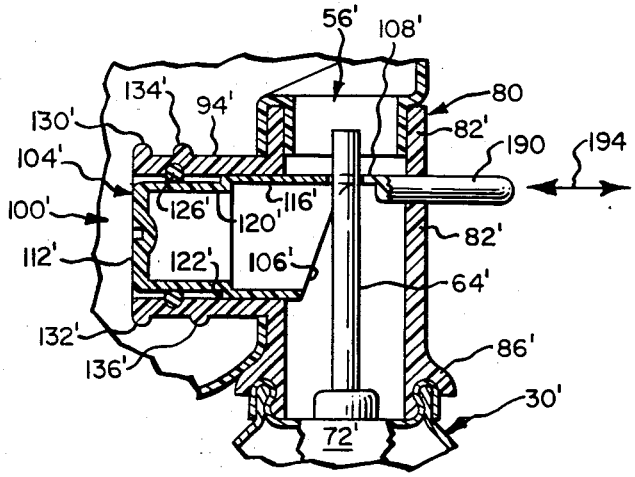

BREATHING APPARATUS

CROSS REFERENCE TO A RELATED APPLICATION

This application is a continuation-in-part of my pending application Ser. No. 404,059 filed Aug. 2, 1982 and entitled "Breathing Mask", now U.S. Pat. No. 4,573,463.

BACKGROUND OF THE INVENTION

This invention relates to the art of breathing apparatus, and more particularly to a new and improved self-contained breathing apparatus in the form of a small-sized mask worn on the face of the user and a light weight breathing gas supply carried by the mask.

One area of use of the present invention is self-contained breathing apparatus to be worn by a user while moving about, although the principles of the invention can be variously applied. It would be highly desirable to provide breathing apparatus in the form of a mask and light weight oxygen supply which can be worn by a person for use during emergency situations, such as fires or medical emergencies. Such apparatus should be effective and safe in operation, light in weight and simple in construction. In addition, it would be desirable to provide such apparatus which is equally effective under both regular and stress conditions. Furthermore, it would be advantageous to provide such apparatus having structure which assures that it is maintained on the face of the user in operative position while the user moves about.

SUMMARY OF THE INVENTION

It is, therefore, a primary object of this invention to provide a new and improved self-contained breathing apparatus in the form of a mask and gas supply adapted to be worn on the face of the user.

It is a further object of this invention to provide such breathing apparatus that is particularly suited for use while the user moves about.

It is a more particular object of this invention to provide such breathing apparatus which is easy to operate and equally effective under both normal and stress conditions.

It is a further object of this invention to provide such breathing apparatus which is effective and safe in operation and yet simple in construction.

The present invention provides breathing apparatus comprising means for defining a breathing chamber in communication with the nose of the user, a gas supply having a movable valve control element, and means operated by the mouth of the user for moving the control to open the valve to introduce gas to the breathing chamber, whereby control of the gas supply is provided by the mouth of the user and inhaling from and exhaling to the chamber is through the nose of the user. The apparatus preferably comprises a mask shaped to contact the user's face around the nose and to define a breathing chamber in communication therewith, a container of breathing gas carried by the mask having an outlet valve communicating with the chamber and operable by a movable control element, operator means carried by the body for operative association with the mouth of the user for moving the valve control element between open and closed positions in response to manipulation by the mouth of the user, and exhalation valve means in the mask in communication with the breathing chamber. As a result, the supply of breathing gas from the container to the breathing chamber is controlled by the user manipulating the operator means with his mouth and inhalation from and exhalation to the breathing chamber is performed by the user through his nose. If desired, there can be included means providing a fluid-tight connection between the gas supply container outlet and an inlet to the breathing chamber, manually operated means for opening and closing the valve, and a pressure gauge in the container for monitoring the pressure of the contents thereof.

The foregoing and additional advantages and characterizing features of the present invention will become clearly apparent upon a reading of the ensuing detailed description together with the included drawing wherein:

BRIEF DESCRIPTION OF THE DRAWING FIGURES

FIG. 1 is a side elevational view of breathing apparatus according to the present invention;

FIG. 1*a* is an end elevational view taken about on line 1*a*—1*a* in FIG. 1;

FIG. 2 is an enlarged sectional view of the apparatus of FIG. 1 showing in detail the mask, operator means and valve control element thereof;

FIG. 3 is a portion of the sectional view of FIG. 2 showing the operator means in one position according to one mcde of operation thereof;

FIG. 4 is a view similar to FIG. 3 showing the operator means in another position illustrating another mode of operation thereof;

FIG. 5 is an elevational view with parts removed taken about on line 5—5 in FIG. 2;

FIG. 6 is a fragmentary sectional view on about line 6—6 in FIG. 2;

FIG. 7 is a fragmentary sectional view illustrating one arrangement for connecting the gas container to the mask inlet;

FIG. 8 is a view similar to FIG. 7 showing another arrangement for connecting the container to the mask inlet;

FIG. 9 is a fragmentary sectional view, partly in elevation, taken about on line 9—9 in FIG. 8;

FIG. 10 is a view similar to FIGS. 3 and 4 illustrating an alternative connection between the operator element and valve control element;

FIG. 11 is a view similar to FIGS. 3 and 4 illustrating the provision of manual means for operating the valve control element; and FIG. 12 is a fragmentary sectional view illustrating a form of the operator means according to another embodiment of the present invention.

DETAILED DESCRIPTION OF THE ILLUSTRATED EMBODIMENTS

FIG. 1 illustrates breathing apparatus 10 according to the present invention including a body generally designated 12 shaped in the form of a mask to contact the face of the user and define a breathing chamber in fluid communication with the user's nose. In the apparatus shown, the mask 12 is shaped to cover the nose and mouth area of a person. Mask 12 preferably is of plastic or like material and molded to include a formation 14 adapted to conform to the nose of the wearer. A reinforcing strip 16 is fixed to the mask body adjacent the area located near the bridge of the wearer's nose. The formation 14 terminates in a curved edge 18 at the upper portion of the mask as viewed in FIG. 1 and the mask body has a pair of curved side edges 20 and 22 extending from edge 18 along the corresponding cheek areas of the user's face toward the chin and neck area whereupon they meet a lower curved edge 24 which is shaped to conform to the chin and lower cheek area of the face below the user's mouth. Thus, when the mask is worn in place on the user's face, the various edges thereof contacting the portions of the face define a closed region around the nose and mouth of the user.

The apparatus is held in place on the head of the user by a strap generally designated 28 in a conventional manner. There can be a single strap connected at opposite ends thereof to mask 12 adjacent side edges 20, 22 and placed around the back of the user's head. Alternatively, two separate straps can be fixed each at one end thereof to corresponding ones of the edges 20, 22 and secured together in an appropriate manner behind the user's head. Other arrangements can of course be employed. The apparatus further comprises means within mask 12 adapted to be gripped between the teeth of the user to facilitate holding the apparatus in place as will be described.

The breathing apparatus further comprises a container 30 for holding a quantity of gas for breathing, and container 30 is adapted for connection to the body of mask 12 for supplying the gas to the interior of the mask in manner which will be described. As shown in FIG. 1, container 30 is elongated, of generally cylindrical shape, and has a valve controlled outlet at the upper end thereof as viewed in FIG. 1 which will be described. The outlet end of the container is connected to mask 12 by means of a connector structure, designated 34 in FIG. 1, of generally cylindrical shape having one end fitted to container 30 and having the opposite end thereof secured to an inlet of mask 12 in a manner which will be described. The material of container 30, together with its size and the gas contained therein, are such that the overall weight is relatively small, for example about four ounces. The structural connection between mask 12 and container 30 is further stabilized by a means of an extension 38 formed in the body of mask 12 near the bottom edge 24 and extending outwardly therefrom at an angle so as to contact the outer surface of container 30. In particular, extension 38 is somewhat solid rectangular in shape, having a longitudinal axis disposed at an acute angle relative to the axis of connector 34, and terminating in a surface 40 disposed at an angle so as to contact the angularly disposed outer wall of container 30 adjacent the outlet thereof.

Referring now to FIG. 2, the interior of mask 12 defines a breathing chamber generally designated 46, which when the mask is in place is in fluid communication with the nose of the user. Mask 12 is provided with an inlet to the breathing chamber in the following manner. The nose formation portion 14 of the mask meets a first front wall portion 48 which is disposed generally parallel to the longitudinal axis of container 30 when the apparatus is assembled. Wall 48 extends along a relatively short distance to about the mid-region of the mask whereupon it meets an inwardly extending wall 50 which is disposed in a plane generally perpendicular to the longitudinal axis of container 30. Wall 50 extends inwardly a relatively short distance, for example about one-third the distance between wall 48 and edges 20, 22 whereupon it meets a second front wall portion 52, disposed generally parallel to wall portion 48, and which extends toward the lower region of the mask whereupon it meets a bottom wall 54 in a curved junction which bottom wall 54 terminates in the aforementioned bottom edge 24. An inlet passage or opening 56 is provided in wall 50 by a cylindrical extension 58 formed in wall 50 and of relatively short axial length. The extension 58 has a longitudinal axis which is substantially coincident with the longitudinal axis of container 30. The second front wall portion 52 is provided with an opening 60 as shown in FIG. 2 for a purpose which will be described.

As shown in detail in FIG. 2, container 30 is of the pressurized type wherein the contents thereof are released in response to pivotal movement of a valve control element in the form of a tube 64 extending from the outlet end of container 30 which serves to convey the discharged contents in response to pivotal movement thereof. The valve operated by tube 64 is a toggle action valve of the type commercially available from Precision Valve Co. The outlet end of container 30 has a wall of progressively decreasing diameter in a conventional manner which terminates in an annular wall portion 66 at the extreme outlet end thereof which is formed to include an annular bead-like formation 68 thereon. The container is closed by an end wall 70 which is relatively thin and conformed such as by crimping or the like over the annular wall 66 and bead 68 thereof. As a result, an annular bead-like formation is included at the outlet end of container 30. The valve structure 72 is located within container 30 on one side of wall 70, and a flexible seal 74 is provided on the opposite end thereof around tube 64. Tube 64 is of sufficient axial length to extend into and terminate adjacent to the mask inlet in a manner which will be described. In the position shown in FIG. 2, wherein the longitudinal axis of tube 64 is coincident with that of container 30, the valve is closed. Upon pivotal movement of tube 64 in either direction such that the axis thereof is at an acute angle to the container axis, the valve is opened and the gas within container 30 is discharged through and along the tube 64.

The apparatus of the present invention further comprises means for connecting container 30 to mask 12, in particular for connecting the outlet of container 30 to the mask inlet 56. The connecting means 80 is in the form of a structure having a generally cylindrical portion 82 which is connected at one end to the extension 58 and at the opposite end to the annular wall formation at the outlet end of container 30. In particular, there is provided a generally cylindrical structure 82 which at one end thereof has an inner diameter substantially equal to the outer diameter of extension 58 whereby the two parts are snuggly fitted together and can be bonded if desired. The axial end wall 84 is in contact with the outer surface of the inwardly extending mask wall 50. As shown also in FIG. 7, the opposite end of the cylindrical structure 82 is formed to include an annular skirt-like formation 86 on the outer surface thereof adjacent the opposite axial end and terminating in an annular surface 88 located axially inwardly of the opposite end surface 90 of cylinder 82 and disposed in a plane substantially parallel to surface 90. Directly inwardly adjacent end surface 90 there is provided an annular bead-like formation 92 and directly adjacent bead there is a wall portion of reduced thickness thereby defining an annular recess of a shape complementary to the annular bead on the end of container 30 so as to provide a snap-fit relationship. Thus, the structure and size of the connecting means 80 is such that when mask 12 and container 30 are assembled as shown in FIG. 2, the surface 40 of mask extension 38 contacts the container outer wall adjacent the container outlet, and the valve control element tube 64 extends into the cylindrical extension 58 for discharging gas to the breathing chamber 46. In addition, the connecting means preferably is formed to include a laterally extending cylindrical structure 94 in the wall thereof adjacent the mask wall 52 and extending through opening 60 into the mask interior for a purpose which will be described.

The breathing apparatus of the present invention further comprises operator means generally designated 100 carried by the body of mask 12 having a portion operatively connected to the valve control element 64 and a portion operatively associated with the mouth of the user for moving the control element 64 in response to manipulation of the operator means by the mouth of the user. In particular, the laterally extending cylindrical portion 94 of structure 82 extends inwardly from opening 60 in mask wall 52 into the interior of the mask and terminates in an annular end face 102. The cylindrical structure 94 has an inner wall of substantially constant diameter. The cylinder 94 serves as a housing for an operator element generally designated 104 which is movable within the cylindrical housing 94. Operator element 104 is connected at one end to the valve control element tube 64 and has an opposite end located so as to be near the user's mouth. In particular, the operator element 104 is generally cylindrical in shape and is open at the end adjacent control element 64, terminating in an edge 106 which is inclined relative to the longitudinal axis of element 104 and meets an extending tab-like extension 108 of the cylinder wall. Tab 108 is provided with an opening 110 through which the outer end of the valve control element tube 64 is inserted. As a result, axial movement of element 104 along within housing 94 is converted to pivotal movement of member 64 for opening and closing the container valve. In the arrangement shown, the tab 108 is located on the upper wall portion of element 104 as viewed in FIG. 2, i.e. at the closest location to the inlet 50. Other arrangements can be employed as will be described. The opposite end of element 104 is closed by a wall 112. In the neutral position of element 104, i.e. with valve element 64 in a position closing the valve, the outer surface of wall 112 is disposed in substantially the same plane as the axial end face 102 of the housing, i.e. the two surfaces as substantially flush. In the neutral position of element 104, the axis of control element 64 is coincident with the axis of container 30 as shown in FIG. 2. A notch or recess 114 in the outer surface of wall 112 is to facilitate rotation of element 104 during assembly of the apparatus to simplify insertion of tube 64 in opening 110.

There is provided stop means for limiting relative extent of travel of operator element 104 within housing 94. As shown in FIG. 2, operator element 104 has a first cylindrical wall portion 116 extending axially inwardly from edge 106 approximately half the length of operator 104 and having an outer diameter substantially equal to the inner diameter of housing 94. The operator 104 has a second cylindrical wall portion 120 having an outer diameter slightly less than that of portion 116 thereby defining an annular shoulder 122 therebetween. Cylinder 94 is provided with annular groove in the inner wall thereof spaced a short distance axially inwardly from end face 102 and in which is seated an O-ring 126. Ring 126 contacts the outer surface of wall portion 120. Thus, as seen in FIG. 2, movement of operator element 104 to the left is limited by engagement between shoulder 122 and O-ring 126.

The operator means 100 further comprises a portion adapted to be received between the teeth of the user in gripping engagement for holding the mask in place on the head of the user. The outer diameter of housing 94 is selected to be of a size comfortably received within the mouth of the user between his teeth. There is provided a first set of extending, tab-like formations 130, 132, shown also in FIG. 5, which are located axially adjacent end face 102 to be received behind the teeth of the user. The tabs 130, 132 are somewhat bead-like in cross-section, of relatively short radial outward extent and which have an arcuate length extending approximately one-sixth along the circumference of cylinder 94. There is provided a second set of tabs 134, 136 of the same size and arcuate length of tabs 130, 132. The tab 134 is located a relatively short axial distance inwardly of tab 130, and the tab 136 is located a slightly larger distance axially inwardly from tab 132.

The apparatus of the present invention further comprises exhalation valve means on the mask body 12 in fluid communication with the breathing chamber 46 for exhausting fluid from the chamber to the atmosphere in response to exhalation by the user. As shown in FIGS. 1 and 2, there is a pair of exhalation valves, one on each side of the mask body adjacent the formation 14. Each valve comprises a plurality of openings in the mask body wall covered by a flexible diaphram-like element fixed to the outer surface thereof. In particular, as shown in FIG. 2, a plurality, for example six, openings 140 are provided in the wall of mask 12. The openings are normally covered by a flexible diaphram-like element in the form of a disc 142 fitted on a formation 144 on the outer surface of the mask body. The disc 142 is of resilient material, for example rubber, which normally closed the openings 140 and allows opening thereof in response to exhalation pressure. A similar exhalation valve having a disc 148 is provided on the opposite side of mask 12 as seen in FIG. 1.

As shown in FIGS. 1 and 1A, container 30 can be provided with pressure gauge means generally designated 150 connected in the axial end thereof opposite the outlet for providing an indication of the pressure of the contents. Gauge 150 has a dial 152 associated with a scale 154 which can be divided into two regions: one indicating safe pressure and the other indicating low pressure, all in a conventional manner.

The breathing apparatus 10 of the present invention is operated in the following manner. The apparatus 10 comprising mask 12 and continer 30 assembled together is relatively small in size and light in weight so as to be easily stored in a convenient and readily accessible location. When it is desired to use the apparatus, the mask 12 with container 30 carried thereby is placed on the face of the user with mask portion 14 generally over the user's nose and the lower region of the mask generally over the mouth. The mask is held in place either by securing the single strap 28 at opposite ends to the mask adjacent the edges 20, 22 and extending it around the user's head or by joining a pair of straps to the mask at edges 20, 21 tying or suitably fastening them behind the head as previously described. When the mask is in place the user also grips the housing 94 between his teeth to further stablize the mask in place and to facilitate holding it in place. When the apparatus is in place, mask 12 is on the user's face and the container 30 depends therefrom in front of the user's neck and upper chest area.

The entire apparatus is relatively light in weight, as will be described, and is conveniently and effectively held in place by the foregoing arrangement.

The operation of apparatus 10 may be summarized by the user controlling the supply of breathing gas by manipulating the operator means 100 with his mouth and breathing in and exhaling through his nose. In particular, in one mode of operation, housing 94 is gripped between the teeth of the user as previously described and the user draws in with his mouth to apply suction against the operator element wall 112 causing the element 104 to move toward his mouth, i.e. pulled toward the left as viewed in FIG. 3 in the direction indicated by arrow 160. Movement of operator 104 to the left causes pivotal movement of valve control tube 64 away from its closed center or rest position as illustrated in FIG. 3 thereby opening the valve and allowing breathing gas to flow from container 30 outwardly through tube 64 into the breathing chamber 46 for inhalation by the user. Very little suction force needs to be applied by the user against element 104, and element 104 can be held in the position in FIG. 3 very easily by suction applied by the user's mouth while he simultaneously inhales from and exhales to the breathing chamber 46.

During inhalation through his nose the user receives the breathing gas discharged from container 30, and during exhalation the exhalation valve is opened allowing exhaust to the atmosphere. The user can continue breathing into and out of chamber 46 with his nose while simultaneously holding the control element in the position illustrated generally in FIG. 3. Engagement of O-ring 126 with shoulder 122 limits the extent of movement of element 104 toward the user as illustrated in FIG. 3. The user can stop the supply of breathing gas to chamber 46 at any time simply by releasing the suction force applied to element 104. This allows the spring bias force on the element 64 to return it to its center or closed position as illustrated in FIG. 2. Valve control element 64 pulls operator member 94 along with it back to the position of FIG. 2. Furthermore, at any subsequent time the user can return the apparatus to the position of FIG. 3 simply by reapplying suction to the element 104 and opening the valve.

FIG. 4 illustrates an alternative mode of operation of the apparatus wherein the user moves element control 104 in the opposite direction, i.e. in the direction indicated by arrow 162. Such movement of element 104 can be accomplished with the user again gripping housing 94 between his teeth and applying force against wall 112 with the tip of his tongue to move element 104 to the right as shown in FIG. 4 thereby moving valve element 64 away from its center position to an open position as illustrated in FIG. 4. Movement of element 104 to the right is limited by engagement between the outer edge of tab 108 and the inner wall of the cylindrical structure 82. The amount of force required to mcve element 104 in the position shown in relatively small, and the user can maintain the position of element 104 with force applied by his tongue while simultaneously inhaling and exhaling into chamber 46. As previously described, the user can stop the supply of breathing gas to chamber 46 at any time simply by releasing force applied to element 104 thereby allowing the spring bias force of element 64 to return the element to its center position where the valve is closed and to return element 104 to the position of FIG. 2. The user can reapply force to element 104 returning it to the position of FIG. 4 at any time. During both modes of operation, O-ring 126 serves to guide and facilitate relative movement between the housing 94 and the element 104.

Container 30 is of a size containing a supply of breathing gas which will last for approximately twenty minutes under normal breathing conditions and for approximately eight to twelve under stress breathing condition. The breathing apparatus of the present invention finds many varied uses. For example, it can be provided for users in hotel rooms, offices and buildings and other typical areas of buildings occupied by persons. The quantity of gas is believed to be sufficient for the duration of typical fire emergency situations in buildings and the like. The apparatus also can be provided for persons in transportation carriers such as small airplanes, subways, trains and the like. Under the foregoing situations container 30 typically would contain a normal gas mixture for breathing. The container also can include a gas mixture tailored for certain medical conditions for use by patients in emergency situations. For example, persons undergoing medical treatment for certain disorders need to have readily accessible a short term supply of breathing gas or oxygen for use in emergency situations. This advantageously can be provided by the apparatus of the present invention. The apparatus is further desirable for use in such situations by virtue of its small size and light weight. In addition, the provision of the means on housing 94 for gripping by the user's teeth complements the holding function of the straps and serves as a substitute holding means in the event the straps should happen to break during an emergency situation.

By way of example, in an illustrative apparatus, container 30 is sized to contain approximately one liter, has an outer diameter of about 2.5 inches and an overall length of 12.5 inches, has a weight of approximately 4.0 ounces when empty, and preferably is of aluminum provided with a smooth epoxy coating on the inner surface thereof and a metal treatment on the outer surface providing a finish which facilitates printing of indicia, advertisements or the like thereon. The container 30 normally is pressurized to about 100 psi, and a typical mixture would include 5 percent helium, 15 percent nitrogen and 80 percent air. The valve associated with control element 64 is a toggle action valve commercially available from Precision Valve Company. While the apparatus is stored and prior to use, the gauge 150 can be checked periodically to monitor the pressure of gas in container 30 to determine if filling is necessary.

FIGS. 8 and 9 illustrate an alternative arrangement for connecting the outlet end of the container to the rest of the apparatus. In FIGS. 8 and 9 components identical to those in FIGS. 1–7 are identified with the same reference numeral having a prime designation. The lower end of the cylindrical structure 82' is provided with a plurality of circumferencially spaced finger-like extensions 170 which begin at approximately the location of the annular groove defined by skirt 86'. Each finger 170 is formed to include a relatively thin wall portion 172 and terminates in an enlarged portion 174 which is somewhat bead-like in shape. When the outlet end of container 30' and the cylinder are pressed together, the fingers 170 flex slightly to provide a snap-fit connection with the annular wall surrounding the outlet end of the container. The flexing of fingers 170 to facilitate the snap-fit connection enhances the tightness of contact between the structure at the lower end of cylinder 82' and the annular bead-like formation on the outlet end of container 30'.

FIG. 10 shows an alternative arrangement for providing connection between operator 104′ and the valve control element 64′. In FIG. 10 components identical to those of FIG. 1–7 are identified with the same reference numerals having a prime designation. The valve control element is in the form of a tube 180 like tube 64 of FIGS. 1–4 but relatively shorter in length, terminating at a location spaced outwardly from the annular wall 50. The operator element 104′ terminates in an edge 182 which is similar to edge 106 of FIGS. 1–4 but inclined in the opposite direction, i.e. from the top wall to the bottom wall as viewed in FIG. 11 whereupon it meets a tab 184 which extends from the lower end of the operator and is provided with an opening 186 through which the tube 180 extends. The arrangement of FIG. 10 allows the use of a valve control element of shorter length. The operation of the apparatus is identical to that disclosed in FIGS. 1–7. Movement of the operator 104′ is in either direction as previously described and indicated by the arrow 188.

FIG. 11 illustrates a form of apparatus having manually operated means for moving the operator element to open the valve entirely by manual operation. In the arrangement of FIG. 11, components identical to those of the embodiment of FIGS. 1–7 are identified by the same reference numeral having a prime designation. A manually operated control member 190 in the form of a rod-like element is movably supported in an opening in the wall of cylinder 82′. Rod 190 has a portion projected externally from cylinder 82′ and another portion extending inwardly and joined to the tab 108. Accordingly, movement of operator 190 in either direction by hand as designated by arrow 194 imparts corresponding movement to operator 104′ and the valve control element 64′ as previously described. Alternatively, operator 190 could be employed in the arrangement of FIG. 10 extending through wall 82′ at a location corresponding to tab 184 where the valve control element 64′ is of shorter length. The manual element 190 enables the user to open the valve in response to pushing element 190 inwardly with his finger in situations where such a manual override of the normal mode of operation is desired or needed.

FIG. 12 illustrates an arrangement according to another embodiment of the present invention. Components identical to those of the embodiment of FIGS. 1–7 are identified by the same reference numerals having a prime designation. In this embodiment the housing portion extending laterally from cylinder 82′ has a first portion 200 of relatively constant diameter and a second portion 202 of gradually decreasing diameter. There is provided a mouth piece element generally designated 206 which has a first body portion including sections 208 and 210 complementary in shape and size to the housing portions 200 and 202, respectively. The mouth piece 206 also has generally curved or arcuate portion 212 extending from the main body in generally opposite directions. It has an edge 212 to facilitate gripping by the teeth of the user. An operator element 218 is movable within the housing and it has a first cylindrical portion 220 of constant diameter and a second portion 222 of gradually decreasing diameter which meets an enlargement 224 located within the mouthpiece 206. The opposite end of operator 218 has an inclined edge 228 which terminates in a tab 230 having an opening 232 for receiving the valve control element 64′. For opening the valve element to discharge breathing gas to the chamber, the user applies force with his tongue to the enlargement 224 in the direction indicated by arrow 230 to move control element 64′ off the center or closed position thereby releasing gas to the breathing chamber in a manner similar to that previously described.

It is therefore apparent that the present invention accomplishes its intended objects. The apparatus is readily worn by the user, even when moving about, and is equally effective in fire, medical and other emergency situations as well as ordinary medical treatment situations. It also is equally effective under both normal and stress breathing conditions. The structure including housing 94 and tabs 130, 132, 134 and 136 gripped by user's teeth assures that the breathing apparatus is maintained on the user while he moves about. The apparatus is effective and safe in operation yet simple in construction.

While several embodiments of the present invention have been described in detail, that is for the purpose of illustration not limitation.

We claim:

1. Breathing apparatus comprising:

(a) a body in the form of a mask adapted to be worn over a user's nose and mouth and defining a breathing chamber adapted to be in fluid communication with only the nose, said body having an inlet in fluid communication with said chamber;

(b) a container holding a quantity of gas for breathing and having an outlet, valve means connected to said outlet for opening and closing thereof, and a movable control means connected to said valve means for opening the same in response to movement of said control means, said container having means adjacent said outlet for direct connection to said body with said container outlet in fluid communication with said body inlet, said movable valve control means adjacent said body inlet and said container adjacent to and supported exclusively by said body, said container releasing a quantity of gas to said chamber and thereby to only the nose of the user in response to opening of said valve means by said control means;

(c) operator means carried by said body for operative connection to said valve control means and for operative association with the mouth of the user for moving said valve control means in response to manipulation by the mouth of the user, said operator means comprising an elongated housing fixed to said direct connection means at one end near said body inlet and having an opposite end spaced from said one end and extending into said body adapted for sealing engagement with the user's mouth when the body is in place, said housing having a longitudinal passage therethrough, and an elongated operator body slidably supported within and extending along the passageway within said housing and into said direct connection means, said body being connected at one end to said valve control means and having an opposite end spaced from said one end and adapted for manipulation by the user's mouth whereby the user moves said operator element along the passageway within said housing by manipulating said opposite end with his mouth; (d) exhalation valve means in said body in fluid communication with said breathing chamber for exhausting from said chamber to the atmosphere in response to exhalation by the user; and (e) means for holding said body on the face of the user;

(f) whereby the delivery of breathing gas from said container to said breathing chamber is controlled by the user manipulating said operator means with his mouth and inhalation and exhalation is performed by the user through his nose from and to said breathing chamber.

2. Apparatus according to claim 1, wherein said housing includes a portion adjacent said opposite end adapted to be received between the teeth of the user in gripping engagement to facilitate holding said apparatus in place on the head of the user.

3. Apparatus according to claim 2, wherein said housing has an outer surface of generally cylindrical shape and wherein said portion adapted to be received between the teeth of the user includes at least one bead-like formation formed on the outer surface of said housing.

4. Apparatus according to claim 1, wherein said operator housing is generally cylindrical in shape and wherein said operator body is substantially cylindrical in shape having an outer diameter slightly less than than the inner diameter of said housing, said body defining extension means at said one end for connection to said valve control element and an end wall closing said opposite end thereof adapted to be manipulated by the user's mouth.

5. Apparatus according to claim 4 further including stop means for limiting the extent of movement of said operator body within said elongated housing and comprising an O-ring seated in an annular groove provided on the inner cylindrical surface of said housing and an annular shoulder formed on the outer cylindrical surface of said operator body for engaging said O-ring to limit moverent of said operator body toward the user's mouth, said shoulder being located between said O-ring and said one end of said operator body.

6. Apparatus according to claim 1, further including stop means operatively associated with said housing and said operator body for limiting the extent of movement of said operator body along the passageway within said housing.

7. Apparatus according to claim 1, further including a manually operable means connected to said operator body for moving said operator body along within said housing in response to manual operation of said means.

8. Apparatus according to claim 1, further including pressure gauge means operatively connected to said container for indicating the pressure of gas in said container.

9. Apparatus according to claim 1 wherein said direct connection means is connected to said body inlet for providing a fluid-tight connection between said container outlet and said body inlet, said container outlet having an annular wall therearound and said connecting means comprising a cylinder defining a flowpath therethrough, said cylinder having one end connected to said body inlet and an opposite end having an end formation means flexible and complementary to said annular wall to provide a snap-fit connection therebetween, said container annular wall having an annular bead-like formation thereon and said end formation means comprising an annular skirt spaced axially from the opposite end of said connecting means defining an annular groove adapted to receive said annular bead-like formation in fluid-tight relation.

10. Apparatus according to claim 9 wherein said end formation means further comprises said opposite end defining a plurality of circumferentially spaced finger-like projections extending axially from the region of said skirt.

11. Apparatus according to claim 10, wherein each of said projections has a bead-like formation on the free end thereof for snap-fitting under said bead-like formation of said container annular wall.

12. Apparatus according to claim 9 further including manually operated means operatively connected to said operator body for moving said valve control means in response to manual operation thereof.

* * * * *